United States Patent [19]

Howell et al.

[11] 4,202,450

[45] May 13, 1980

[54] FLEXIBLE WALL POUCH WITH LABEL

[75] Inventors: Bryan G. Howell, Montreal; Gordon H. Ringrose, Pointe Claire, both of Canada

[73] Assignee: Twinpak Ltd., Dorval, Canada

[21] Appl. No.: 9,789

[22] Filed: Feb. 6, 1979

[51] Int. Cl.[2] ..... B65D 75/28

[52] U.S. Cl. ..... 206/459

[58] Field of Search ..... 206/459; 150/1; 40/10 D

[56] References Cited

U.S. PATENT DOCUMENTS 2,796,982 6/1957 Volckening ..... 206/459

*Primary Examiner*—Donald F. Norton

*Attorney, Agent, or Firm*—Swabey, Mitchell, Houle, Marcoux & Sher

[57] ABSTRACT

A flexible transparent pouch having a double wall, a heat sealed bond at the extremities thereof, a strip of flexible material having a label extending between the bonds and located between a pair of films making up the double wall, the strip being connected to the extremities of the pouch at the heat sealed bonds.

3 Claims, 3 Drawing Figures

FLEXIBLE WALL POUCH WITH LABEL

BACKGROUND OF THE INVENTION

1. Field of the Invention

The present invention relates to flexible containers, and more particularly, to a transparent type of flexible container for use in containing liquids directed for human consumption.

2. Description of the Prior Art

In the bulk liquid container field, particularly with regard to servicing restaurants and the like, a five-gallon size container has been found to be the best size of container. In the past, milk was delivered to restaurants and public dining facilities in metal containers. Then came the advent of the corrugated carton having a polyethylene liner fixed to the inside of the carton, and a heavier density polyethylene spout attached to both the liner and the carton. These containers were ideal for stacking and for handling, and the costs of shipping were reduced since the containers were disposible. However, with the ever-increasing cost of fiberboard material, such as corrugated boxes, a new flexible disposible pouch has been developed to replace the corrugated box with the liner container.

The newer container is in the form of a five-gallon pouch made up of a double wall of polyethylene material with a heavier density polyethylene spout piercing a wall of the pouch and adhered thereto in a sealed manner.

In the era of the carton box with the polyethylene liner, it was reasonably easy to identify the product, the date the product was filled in the flexible container, and the trade mark label of the dairy supplying the bulk milk, since this need merely be adhered to the outer box or printed thereon. However, there are problems in labeling the present flexible pouch made up of transparent polyethylene sheet material. It is well known to print on such polyethylene sheet material by first treating the sheet material with a corona discharge. However, sheet material which has been treated by corona discharge tends to be less susceptible to heat sealing, and a strong heat seal bond is essential when one is dealing with five-gallon liquid pouches.

Furthermore, since the film being used to form the pouches is supplied in rolls, the rolls must be unwound in order to print adjacent layers of double wound film. The film is thus exposed to the atmosphere, and furthermore, the under-wound film, which is destined to form an inner surface and therefore be in contact with the milk, is in contact with the ink on the printed film, thereby possibly retaining odors from the ink and transferring these to the milk. It is preferable that the film to be used for forming the liquid pouches have as little exposure to the atmosphere as possible to reduce contamination. Further, it is evidently undersirable to have ink odors transferred to the contents of the pouches.

An obvious solution would be to provide sticker type labels which can be adhered to the outside surface of the pouch. However, these stickers can be accidentally or deliberately removed during handling, thereby increasing the risk of aged or otherwise contaminated milk or other food products being passed on to the public.

SUMMARY OF THE INVENTION

It is an aim of the present invention to provide a safe and secure label for liquid carrying pouches, particularly those pouches destined to carry food products.

It is also an aim of the present invention to provide an improved article comprising a flexible wall transparent container having a label incorporated therein.

It is also an aim of the present invention to provide an economic, flexible, transparent wall bulk liquid container with a suitable identifying label.

In a construction in accordance with the present invention, there is provided a container, the walls of which are of two-ply thickness and at least the outer ply being transparent. An identifying label strip is provided within the two plies of a wall of the container and is connected to opposed heat seal bonds forming the container ends such that the label strip is held at either end to the heat seal bond.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2, 3:
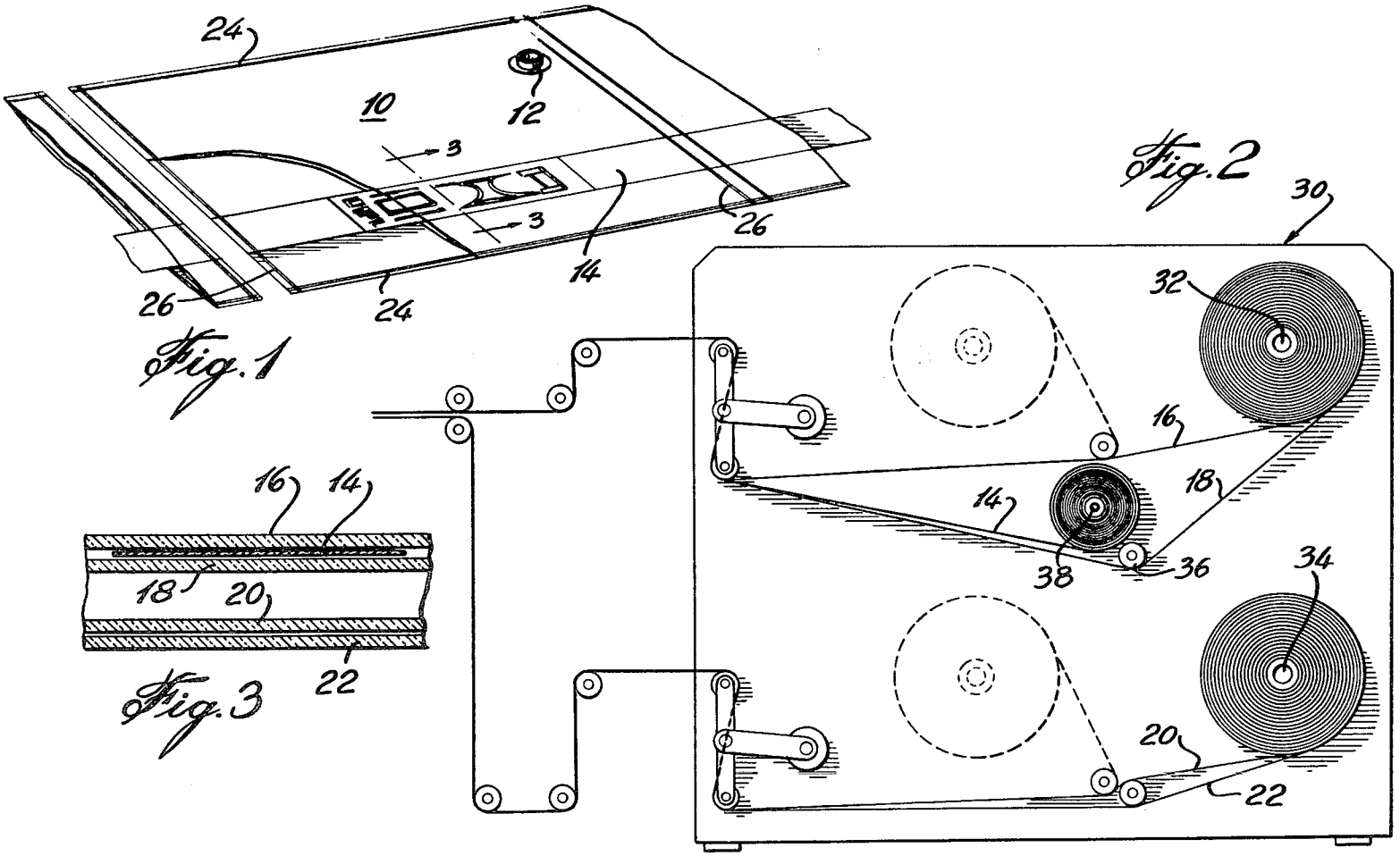
FIG. 1 is a perspective, partly fragmentary view of a container having a label in accordance with the present invention.
FIG. 2 is a vertical elevation, schematically representing the feed unit of a pouch forming apparatus.
FIG. 3 is a cross-sectional view taken through line 3—3 of FIG. 1.

Referring now to the drawings, there is shown a flexible container only partly separated from a continuous series of similar containers 10. Each container 10 includes a spout 12 and a label strip 14. The container is formed with four film thicknesses of polyethylene material forming a double walled pouch. As shown in FIG. 3, the container 10 can have the film 16, 18, 20 and 22 with a heat seal bond 24 on either longitudinal edge thereof and lateral heat seal bonds 26 along the lateral edge thereof.

As shown in FIGS. 1 and 3, the container 10 is approximately 23 inches square, and each film 16, 18, 20 and 22 is approximately 2 to 3 mils in thickness. On the other hand, the label strip 14 which could be of a thinner polyethylene would be approximately 0.5 to 4 mil thick. The label strip 14 would be a narrow continuous strip which may have been treated with corona discharge or other process in order to make it more susceptible to printing. The printed label portion could be intermittently printed on the strip, thereby leaving a space between the printed label on the strip in the area of bonding. It has been found that the heat seal bond does not take too well over the printed material. The strip label 14 may have only a solid colour for identification or may have continuous printing with an ink which does not affect the heat seal bond.

The spout is heat sealed in a continuous process for making the pouch and is welded to the upper two films 16 and 18 making up one of the walls of the pouch.

By placing the label as such between two layers making up one wall of the pouch, it is readily visible from outside the pouch, and the strip can, of course, be custom fitted according to a client's requirements. By providing such a strip of printed film, it is not necessary to treat the outer pouch for receiving labels and, therefore, it does not interfere with the actual structure of the pouch.

Referring now to FIG. 2, a feed mechanism for making up a series of double walled flexible polyethylene pouches is shown at 30. A pair of rolls 32 and 34 are provided, and these rolls each supply a double film of polyethylene sheet material in the proper size. If the feed mechanism is automatic in nature, alternate feed rolls can be provided, as shown in dotted lines. As shown, the films 16 and 18 are paid off from the roll 32 and proceed towards the heat sealing station. However, a roller 36 forces the films 16 and 18 to be spread apart, and a label strip supply roller 38 is provided between the films 16 and 18 and supplies a continuous label strip 14. The roller 38 can be controlled to retard and therefore stretch slightly the label strip 14 so as to centrally locate the printed label area of the strip as it is being fed in the pouch assembly. Finally, the other double wall is formed by supplying films 20 and 22 of suitable polyethylene material in the same manner over a series of rollers to the heat seal station, not shown. The four layers, 16, 18, 20 and 22, are then heat sealed in a conventional manner, and the heat seal process also binds the edges of the strip of the label film 14 at 26.

We claim:

1. A flexible transparent pouch having at least a double wall, a heat sealed bond at the extremities thereof, a strip of flexible material having a label extending between the bonds and located between a pair of films making up the double wall, the strip being connected to the extremities of the pouch at the heat sealed bonds.

2. A flexible transparent pouch as defined in claim 1, wherein the label strip is a film of polyethylene having a thickness between 0.5 to 4 mil.

3. A flexible transparent pouch having at least a double wall, a heat sealed bond at the extremities thereof, a strip of flexible material on which a label has been printed extending between the bonds and located between a pair of films making up the double wall, the strip being connected to the extremities of the pouch at the heat sealed bonds, the label area including the printed intelligence being spaced from the heat sealed bonds of the pouch forming the label so as not to interfere with the bonds.

* * * * *